United States Patent [19]

Bene et al.

[11] 4,224,772

[45] Sep. 30, 1980

[54] WINDOW CONSTRUCTION

[75] Inventors: Robert Bene, Andover; Joseph A. Fortini, New Haven, both of Conn.

[73] Assignee: Country Log Homes, Inc., Ashley Falls, Mass.

[21] Appl. No.: 949,645

[22] Filed: Oct. 10, 1978

[51] Int. Cl.[2] ..... E04B 1/10

[52] U.S. Cl. ..... 52/233; 52/213

[58] Field of Search ..... 52/204, 203, 207, 210, 52/213-217, 233

[56] References Cited

U.S. PATENT DOCUMENTS

| | | | |
|---|---|---|---|
| 1,510,326 | 9/1924 | Locke | 52/233 |
| 2,321,120 | 6/1943 | Baker | 52/233 |
| 2,403,934 | 7/1946 | Lindstrom | 52/233 |
| 2,550,883 | 5/1951 | St. Vincent | 52/233 |
| 2,706,837 | 4/1955 | Jackson | 52/215 |
| 2,787,029 | 4/1957 | Johnson | 52/233 |

*Primary Examiner*—James L. Ridgill, Jr.

*Attorney, Agent, or Firm*—McCormick, Paulding & Huber

[57] ABSTRACT

A window is secured within a window opening in a log wall for vertical movement within the opening and relative to the wall to compensate for wall settlement. Connecting members are at least partially disposed within the opening and between the jamb members which comprise the window frame and the logs which define vertically disposed sides of the opening. The connecting members are secured in fixed position to the window frame and have vertical slots which receive fasteners which secure the connecting members to the logs which define the sides of the opening to facilitate vertical movement of the window within the opening and relative to the wall. Another embodiment is disclosed wherein connecting members secured in fixed position to the window frame are received within vertical slots formed within the logs which define the sides of the window opening.

9 Claims, 9 Drawing Figures

WINDOW CONSTRUCTION

BACKGROUND OF THE INVENTION

This invention relates in general to improvements in log buildings and deals more particularly with improved means for mounting the windows in such a building. A building of the type with which the present invention is concerned has exterior walls formed by horizontally extending log courses arranged in vertically stacked relation. Conventional windows of double-hung or casement type are mounted in window openings formed in the log walls. Such walls are prone to settle due to log shrinkage and because each of the logs which comprise the walls must carry the weight of all of the logs thereabove. Such wall settlement may cause changes in the vertical dimensions of window openings resulting in damage to the windows or separation of the joints between adjacent logs which define the window openings necessitating window removal and replacement. The present invention is concerned with these problems.

SUMMARY OF THE INVENTION

In accordance with the present invention, a window has a frame which includes vertically disposed jamb members and is received within the window opening in a log wall formed by horizontally extending log members arranged in vertically stacked relation. Connecting members are at least partially disposed within the opening and between the jamb members and the logs which define vertically disposed sides of the opening. Retaining means cooperate with the connecting members for securing the window frame to the wall and within the opening to move vertically within the opening and relative to the wall.

DETAILED DESCRIPTION OF PREFERRED EMBODIMENTS

Figure 1:
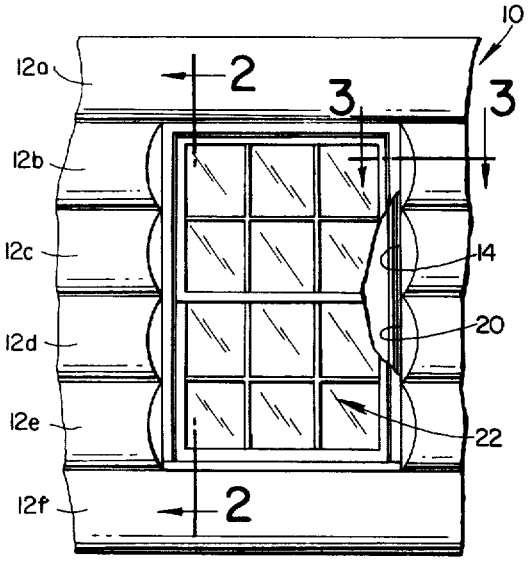
FIG. 1 is a fragmentary elevational view of a portion of a log building embodying the present invention.

Turning now to the drawings and referring particularly to FIGS. 1-4, a log building embodying the invention has a log bearing wall shown, in part, and indicated generally by the reference numeral 10. The wall 10 includes a plurality of horizontally extending and vertically stacked logs 12*a*-12*f* connected in tongue and groove relation which define a window opening 14.

Figure 2:
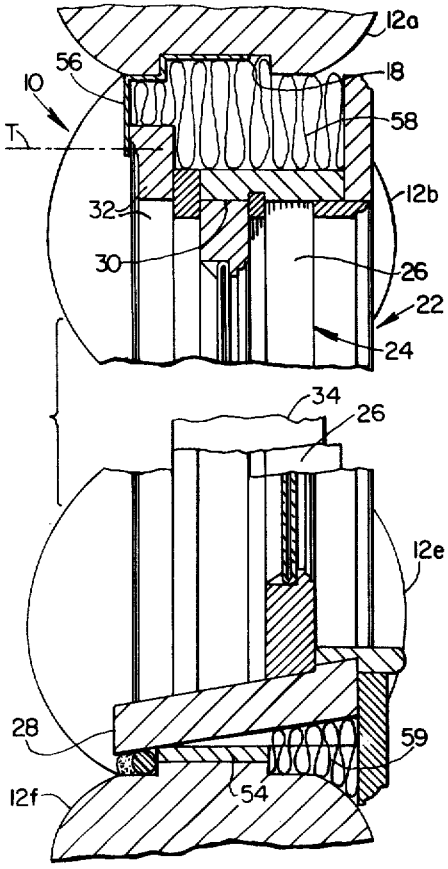
FIG. 2 is a somewhat enlarged fragmentary vertical sectional view taken along the line 2—2 of FIG. 1.

Each log is formed from a log cant and has a longitudinally extending tongue 16 which projects above its upper surface and the longitudinally extending groove 18 which opens through its lower surface, as best shown in FIG. 2. The opposing ends of logs 12*b*-12*e* define the vertically disposed sides of the window opening, the sides of the opening being indicated at 20, 20. The lower side of the opening 14 is or may be defined by a tongue 16 on the log 12*f*.

A conventional double-hung window indicated generally at 22 is received within the window opening 14 and retained therein as will be hereinafter further discussed. The window 22 has a frame indicated generally at 24 which includes vertically disposed jamb members 26, 26 connected together by a horizontally disposed sill member 28 and a horizontally disposed header member 30. A conventional rectangular brick mold 32 is secured to the exterior side of the frame 24 and projects laterally outwardly beyond the frame members 26, 26 and above the header member 30. The window frame 24 which includes the brick mold 32 is received within the opening 14 and it should be noted that vertical dimension of the opening 14 is somewhat larger than the major vertical dimension of the frame 24.

The window 22 is secured to the wall 10 and retained within the opening 14 for vertical movement therein and relative to the wall. More specifically, the window 22 is secured to the wall by connecting members 34, 34 attached in fixed position to the frame 24. The connecting members are, in turn, secured to the wall 10 for vertical movement within the opening 14 and relative to the wall.

Figure 5:
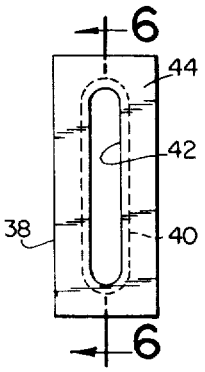
FIG. 5 is a somewhat enlarged front elevational view of a connecting member insert.
Figure 6:
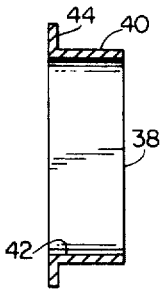
FIG. 6 is a vertical sectional view taken along the line 6—6 of FIG. 5.

Each connecting member 34 comprises a vertically elongated wooden member and has vertically extending apertures or slots 36, 36 which extend through it. The vertical dimension of each connecting member 34 may be equal to but does not exceed the vertical dimension of an associated jamb member 26. Preferably, and as shown, an insert 38 is positioned within each slot 36. Each insert may be made from plastic, metal, or other suitable material and has an elongated sleeve portion 40 which defines a slot 42 and a flange portion 44 which surrounds the periphery of the sleeve portion 40, as best shown in FIGS. 5 and 6. Each connecting member 34 is received within the opening 14 and is disposed between a jamb member 26 and an associated opening side edge 20.

Figure 3:
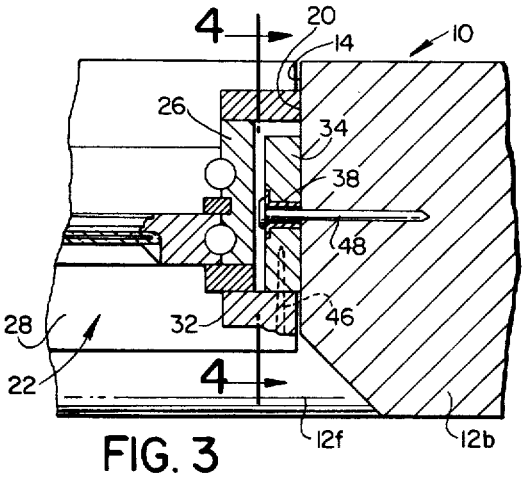
FIG. 3 is a somewhat enlarged fragmentary horizontal sectional view taken generally along the line 3—3 of FIG. 1.
Figure 4:
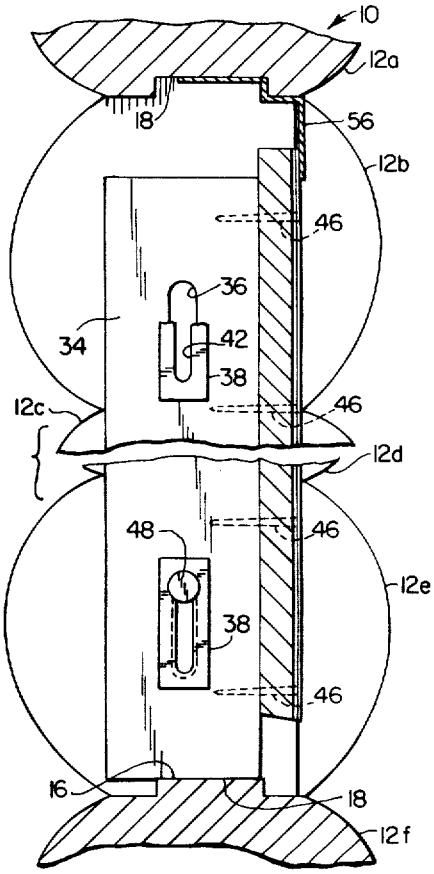
FIG. 4 is a fragmentary vertical sectional view taken along the line 4—4 of FIG. 3.

The connection members 34, 34 are preferably attached in fixed position to the frame 26 by finishing nails, indicated at 46, 46, driven through opposite side portions of the brick mold 32 and into connecting members 34, 34, as best shown in FIGS. 3 and 4. Additional fasteners or nails 48, 48 which extend through the slots 42, 42 and are driven into the logs which define the edge surfaces 20, 20.

Preparatory to installing the window 22 within the wall 10, a block 54 is secured to the upper surface of the tongue 16 on the log 12*f* which defines the bottom of the opening 14. Stepped flashing 56 is installed along the upper exterior edge of the opening 14 within the groove 18 in the log 12*a*, substantially as shown in FIG. 2. The connecting members are next positioned within the opening. The illustrated connecting members 34, 34 are substantially equal in vertical length to the jamb members 26, 26 and are positioned within the opening 14 respectively adjacent the side edges 20, 20 with the lower ends thereof in contact with the block 54. The nails 48, 48 are inserted through the upper portions of the slots 42, 42 and driven into the logs which define the sides 20, 20. Thus, each connecting member 34 is supported for limited vertical movement in an upward direction within the opening 14 and relative to the wall 10. The window 22 is now positioned within the opening with lower ends of the jamb members resting on the block 54 and the inwardly facing side edge surfaces of the brick mold 32 respectively engaging associated outwardly facing surfaces of the connecting members 34, 34. The finishing nails 46, 46 are now driven through the brick mold 32 and into the connecting members 34, 34.

Suitable mastic sealing or caulking material may be provided between the sill 28 and the log 12*f* which generally defines the bottom of the window opening 14. Insulating material such as indicated at 58 may be secured in the space between the header member 30 and the log 12*a* immediately thereabove. Additional insulating material such as indicated at 59 may be installed between the sill member 28 and the log 12*f* immediately below the sill member. Suitable finish trim is preferably nailed to the interior side of the window frame to complete the installation, as shown in FIG. 2.

After installation the lower surfaces of the jamb members 26, 26 rest upon the block 54 so that maximum available clearance is provided between the upper surface of the brick mold 32 and the associated lower surface of the flashing 56. The manner in which the window 22 is secured within the opening 14 by the slotted connecting members 34, 34 and the fasteners 48, 48 permits a substantial amount of relative vertical movement between the wall 10 and the window 22. Thus, normal settlement which occurs within the wall due to log shrinkage and the weight of the logs which bear down against other logs therebelow is compensated for by the vertical floating mounting arrangement of the window 22 relative to the wall 10. It will be apparent that all of the logs within the wall 10 and above the log 12*f* may settle to some degree without causing movement of the window relative to the sill supporting log 12*f*. The aforesaid log settlement reduces the vertical gaps between the flashing 56 carried by the log 12*a* and the brick mold at the top of the window frame 24. In the event that the vertical settlement which does occur is greater than anticipated, the flashing 56 may engage the brick mold 32 immediately therebelow. However, to compensate for this excessive settlement the depending lip of the flashing 56 is bent upward to expose the horizontally extending brick mold 32 immediately under the flashing. The brick mold may then be trimmed, as necessary, and along a horizontal trim line, such as the line T indicated in FIG. 2, to provide additional clearance and without removing the window 22 from the wall opening 14.

Figure 7:
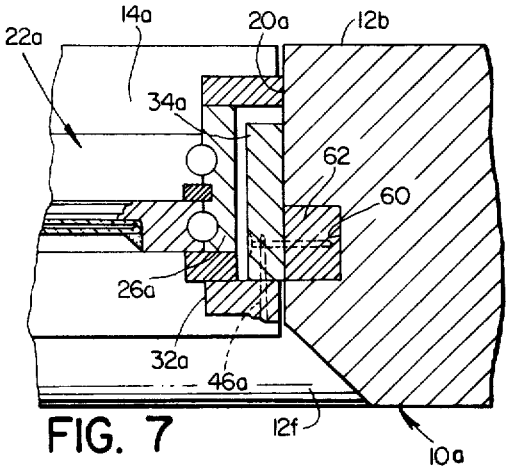
FIG. 7 is similar to FIG. 3, but shows another embodiment of the invention.
Figure 8:
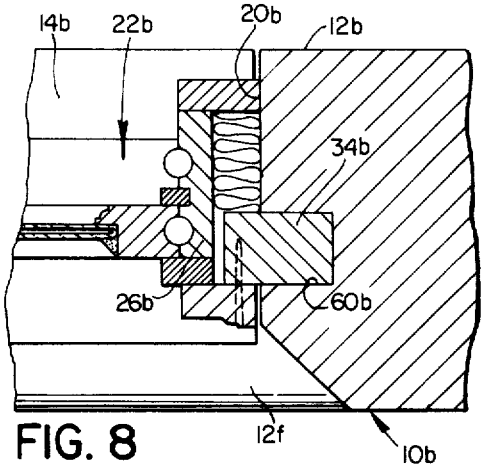
FIG. 8 is also similar to FIG. 3 but shows still another embodiment of the invention.

Further embodiments of the invention are illustrated in FIGS. 7 and 8. Parts of the illustrated embodiments correspond to parts of the previously described embodiment and bear the same reference numerals and a lower case letter suffix and will not be hereinafter described in detail.

Referring now to FIG. 7, a wall 10*a* includes a plurality of vertically stacked horizontally extending logs 12*a*–12*f* (12*b* and 12*f* shown). The logs cooperate to define a window opening 14*a* which has vertically disposed side edges 20*a* (one shown). A window 22*a*, substantially identical to the window 22, previously described, is received within the opening 14*a* and retained therein for vertical movement relative to the wall 10*a* as required to compensate for wall settlement. The logs 12*b*–12*e* which define the vertically disposed side edges 20*a*, 20*a* have grooves 60, 60 formed therein (one shown) which open through the side edges 20*a*, 20*a* and communicate with the opening 14*a*. connecting members 34*a*, 34*a* which comprise elongated members are preferably made in two parts. Each member 34*a* has a generally L-shaped cross sectional configuration, as viewed from above in FIG. 7. Each connecting member 34*a* is at least partially disposed within the opening 14*a* and between the jamb member 26*a* and an associated vertically disposed side edge 20*a*. Each connecting member 34*a* has an extending leg portion 62 received within an associated groove 60, substantially as shown. Thus, the grooves 60, 60, cooperate with the connecting members 34*a*, 34*a*, to secure the window 22*a* within the wall 10*a* and more specifically within the opening 14*a* to move vertically within the opening and relative to the wall 10*a*. The connecting members 34*a* are secured in fixed position to associated portions of the brick mold 32*a* by finishing nails 46*a*, 46*a*, substantially as shown. The members 34*a*, 34*a* are made in two parts to facilitate assembly at the job site which allows for leveling or plumbing to compensate for wall irregularities or tolerances, as may be required.

The further embodiment of the invention illustrated in FIG. 8 has a log wall indicated generally at 10*b*. Connecting members 34*b*, 34*b* which comprise vertically elongated strips may be made from wood, plastic or any other suitable material and have a rectangular cross section, as viewed from above, and secure a window 22*b* within a window opening 14*b* for vertical movement within the opening and relative to the wall 10*b*. Each connecting member 34*b* is partially disposed within the opening 14*b* and between a jamb member 26*b* and an associated side edge 20*b*. Grooves 60*b*, 60*b* (one shown) cooperate, respectively, with the connecting members 34*b*, 34*b* to retain the window 24*b* within the opening 14*b* for vertical movement therein and relative to the wall 10*b*.

Figure 9:
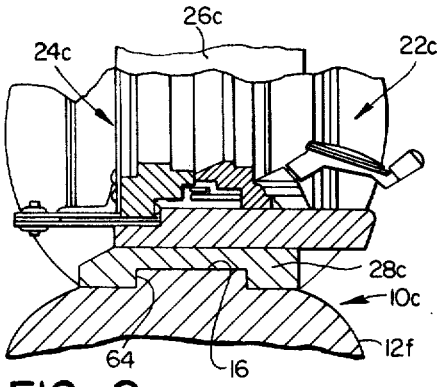
FIG. 9 is a fragmentary vertical sectional view similar to FIG. 2, but shows a further embodiment of the invention.

In FIG. 9 there is illustrated an arrangement for securing a casement window 22*c* within a window opening formed in a log wall 10*c*. The casement window 22*c* is similar in some respects to the double-hung windows previously described and has a frame 24*c* which includes jamb members 26*c*, 26*c* and a sill member 28*c*. However, the sill member 28*c* is substantially horizontally disposed and has a dado cut 64 formed in its lower surface which complements the tongue 16 on a sill supporting log 12*f*. Thus, the sill 28*c* rests directly upon the tongue 16 of the sill supporting log 12*f*. Any of the arrangements hereinbefore described with reference to FIGS. 1–4, 7 and 8 may be utilized, as desired, to secure the window 22*c* within the wall 10*c* for vertical movement within the opening 14*c* and relative to the wall 10*c*.

We claim:

1. A log building having a wall including a plurality of horizontally extending log members arranged in vertically relation and defining a window opening, a window having a frame received within said opening and including at least one window sash supported on said frame for movement relative thereto, said frame including vertically disposed jamb members, vertically elongated wooden connecting strips at least partially disposed within said opening and between said jamb members and said logs defining vertically disposed sides of said opening, said strips having vertically extending apertures formed therein and extending therethrough, inserts having vertically disposed slots and received within said apertures, retaining fasteners attaching said connecting members in fixed position to said frame, and additional fasteners extending through said slots and securing said strips to said wall for vertical movement relative to said wall whereby said window frame is secured to said wall and within said opening to move vertically within said opening and relative to said wall.

2. A log building having a wall including a plurality of horizontally extending log members arranged in vertically stacked relation and defining a window opening, a window having a frame received within said opening and including at least one window sash supported on said frame for movement relative thereto, said window frame including vertically disposed jamb members, a pair of vertically elongated connecting strips, each of said strips having at least two vertically spaced apart vertically extending apertures therethrough, each of said strips being disposed within said opening and between an associated one of said jamb members and said logs defining an associated vertically disposed side of said opening, retaining fasteners securing said strips in fixed position to said window frame, and additional fasteners extending through said apertures and into said wall and securing each of said connecting strips to said wall for vertical movement relative thereto whereby said window frame is secured to said wall and within said opening to move vertically within said opening and relative to said wall.

3. A log building as set forth in claim 2 wherein the vertical dimension of said jamb members is at least equal to the vertical dimension of said connecting strips.

4. A log building as set forth in claim 2 wherein said logs are connected together in tongue and groove relation and the lower side of said window opening is defined by a tongue on an associated one of said logs, said jambs resting on said tongue of said one log.

5. A log building as set forth in claim 2 wherein said logs are connected together in tongue and groove relation and the lower side of said window opening is defined by a tongue on an associated one of said logs and including block means resting upon and secured to the tongue on said one log within said opening.

6. A log building as set forth in claim 2 wherein said frame includes brick mold and said connecting strips are secured to said brick mold by said retaining fasteners.

7. A log building as set forth in claim 6 wherein said brick mold is disposed within said window opening and extends above said jamb members and the vertical dimension of said jamb members is at least equal to the vertical dimension of said connecting strips.

8. A log building as set forth in claim 2 wherein said strips are made from one material and including a plurality of inserts made from another material, each of said inserts being received in an associated one of said apertures and having a vertically disposed slot therein receiving an associated one of said additional fasteners therethrough.

9. A log building as set forth in claim 8 wherein said one material is wood and said other material is metal.

* * * * *